United States Patent [19]

Jespersen et al.

[11] 4,453,586

[45] Jun. 12, 1984

[54] METHOD OF PRODUCING FROZEN CASTING MOULDS

[75] Inventors: Emil Jespersen, Glostrup; Bakshi B. Singh, Hørsholm, both of Denmark

[73] Assignee: Dansk Industri Syndikat A/S, Herlev, Denmark

[21] Appl. No.: 355,580

[22] PCT Filed: Jun. 22, 1981

[86] PCT No.: PCT/DK81/00062

§ 371 Date: Feb. 17, 1982

§ 102(e) Date: Feb. 17, 1982

[87] PCT Pub. No.: WO82/00015

PCT Pub. Date: Jan. 7, 1982

[51] Int. Cl.[3] ..... B22C 9/02

[52] U.S. Cl. ..... 164/37; 164/6; 164/15; 164/526; 106/38.2

[58] Field of Search ..... 164/6, 12, 15, 37, 522, 164/525, 45, 518, 526; 523/142, 143, 307, 309; 106/38.2

[56] References Cited

U.S. PATENT DOCUMENTS

| | | | |
|---|---|---|---|
| 4,150,704 | 4/1979 | Hoult | 164/12 |
| 4,243,093 | 1/1981 | Nieman | 164/45 |

FOREIGN PATENT DOCUMENTS

| | | | |
|---|---|---|---|
| 3005765 | 8/1980 | Fed. Rep. of Germany . | |
| 2909839 | 9/1980 | Fed. Rep. of Germany | 164/6 |
| 2912201 | 10/1980 | Fed. Rep. of Germany | 164/6 |
| 51-20409 | 6/1976 | Japan | 164/15 |
| 53-78929 | 7/1978 | Japan | 164/12 |
| 54-139827 | 10/1979 | Japan | 164/526 |
| 54/52623 | 12/1979 | Japan | 164/525 |
| 55-48452 | 4/1980 | Japan | 164/525 |
| 2011432 | 7/1979 | United Kingdom | 164/525 |
| 0616052 | 7/1978 | U.S.S.R. | 164/15 |

OTHER PUBLICATIONS

Derwent's Abstract No. 74607c/42, SU718 215 Published 1980, Feb. 28, Gruzman, V. M.

Patent Abstracts of Japan, Abstract of JP 55-1905 Published Jan. 9, 1980, Jiyunsaka Nakashima.

*Primary Examiner*—Gus T. Hampilos

*Assistant Examiner*—Richard K. Seidel

*Attorney, Agent, or Firm*—Fleit, Jacobson, Cohn & Price

[57] ABSTRACT

To produce frozen casting moulds or core boxes the binder is cooled till freezing at least partly before or during the moulding process. This allows the production rate to be increased to such a level that the working rate of automatic machines for the production of casting moulds and core boxes can be fully obtained.

9 Claims, No Drawings

METHOD OF PRODUCING FROZEN CASTING MOULDS

The invention relates to a method of producing frozen casting moulds or cores of a granular material and a binder in a mould chamber or a core box, comprising the use of a freezable binder which is in a gas or liquid state at positive temperatures calculated in ° C.

The specification of the U.S. Pat. No. 4,150,704 teaches a method in which the mould sand is admixed with a controlled quantity of water which after moulding is frozen to ice in a certain depth from the surface that is caused to contact molten metal e.g. by placing a layer of so-called dry ice or spraying liquid nitrogen on the surface. This gives a very strong mould surface which retains its strength and shape until the surface of the metal has solidified. As the metal gives off its heat, the water melts and evaporates so that the mould begins collapsing without the use of mechanical means. Practically no smoke is developed in the casting process, and the mould sand can be reused right away.

An article in the Russian magazine Liteinoe Proizvodsto, 1975, no. 5, p. 21–22, describes the freezing of a sand mould containing 3 to 7% water by means of a coolant that circulates through the evaporator in a cooling system and through the mould.

Freezing of the added water is by nature a rather slow process, and consequently it takes a relatively long time from the moment when the moulding process is finished until the mould has frozen deep enough to be able to resist the effect of molten metal for a sufficiently long time, and this in turn causes the overall mould production to become considerably more time-consuming than the conventional mould manufacturing processes.

The object of the invention is to overcome this drawback of the known embodiments of the present method, and this object is achieved in that the binder has been frozen before the moulding process or is rapidly brought down below its freezing point during said process in that at least one of the tools and/or materials that the binder, which itself may have been precooled, is caused to contact in the moulding process, has been cooled in advance. In this embodiment part or the entire necessary cooling may have been effected in advance, i.e. before the moulding process, so that the molten metal may be poured into the mould immediately after the termination of the moulding process. This provides for such a great production rate that the method may be used in connection with fast working automatic machines for the production of casting moulds with or without cores, e.g. of the type disclosed in the applicants' Danish patent specification No. 87 462 to obtain the high operation rate of this machine.

When the binder has been frozen before the moulding process, it may be expedient that additionally at least one of the tools and/or materials which the binder is caused to contact in the moulding process or in the mould and which may contain a binder previously used, has been cooled below the freezing point of the binder or to a temperature slightly above said freezing point.

Furthermore, the mould binder may have been cooled before the mould manufacturing process so that it is present in the form of fine, dendritic particles, e.g. snow, in the mould material, and a compression during the moulding process may entail that the binder obtains part of or its entire binding capacity depending upon the temperature conditions at the time of the mould manufacturing process.

The mould binder used may also have been cooled before the mould manufacturing process so that it is present in the form of a finely divided powdered material, e.g., ice in the mould material, and a compression during the moulding process may entail that the binder obtains part of or its entire binding capacity depending upon the temperature conditions at the time of the mould manufacturing process.

When a suitable mixture of granular material and snow or broken ice is compressed in a mould box, the snow or the ice may thus be caused to bind the grains of the material together to impart a cohesive force to the mould or the core sufficient for it to resist the effect from liquid metal which is poured down into the finished mould with or without cores. A corresponding effect can be achieved by injecting one of the mentioned mixtures of mould material into a core box with a sufficiently great force and at a sufficiently great rate.

The precooled binder in the form of pulverized material may also be combined with liquid gas. This permits the temperature of the mould material to be reduced to a very low value before and during the moulding process and during the immediately following casting process. The mixture must be homogenous and easy flowing.

Actually, there is nothing to prevent the use of conventional setting binders. Thus, to form a binder there may be used water glass and liquid carbon dioxide, or a mixture of polyisocyanate and phenol resin which is activated by precooled, liquid dimethylethyl amine or triethyl amine. This provides for a reduction in the use of an environmentally harmful binder.

To obtain a better resistance to the heat effect of the molten metal and thereby a delay in the heating of the mould or the core in the casting process, the granular material used for the formation of the mould or the core may have been deep frozen in advance.

Additionally, the process ingredients may have been deep-frozen in advance by means of an admixed freezing agent, and the freezing agent used may expediently be liquid gas. The use of an inert gas obviates any risk of chemical attacks on the equipment used for the process or for chemical reactions with the casting metal.

The required cooling may also be effected or be supported by deep-freezing the parts of the apparatus which the mould material contacts during the moulding process. In the production of casting moulds, particularly the pattern board which contacts the same mould surface as the molten metal does later, may have been deep-frozen in advance, and a core box deep-frozen in advance may be used in the production of cores. Also, the core box with the core or cores may be cooled simultaneously and additionally, as e.g. with liquid gas.

A specific embodiment of the method of the invention in the production of casting moulds comprises the use of deep-frozen disposable patterns of a material which evaporates when heated, and this material may expediently have been deep-frozen and foamed. Such patterns may be produced currently in a particular bifurcate pattern mould box corresponding to a conventional core box and be placed in a closed chamber, following which the space between the pattern and the walls of the chamber is filled with the moulding material which is cooled by the pattern and may additionally have been cooled in advance as mentioned above. After the moulding process is finished the pattern evaporates rapidly owing to the heat received. This obviates the inconvenient development of gas, which otherwise takes place in the moulding of disposable patterns. This embodiment of the method results in particularly accurate castings because the inaccuracies which in the conventional mould manufacturing process result from wear on the pattern board caused by shootings of sand, are avoided. Moreover, bifurcation of the mould box is not required when readily evaporable patterns are used.

The invention also relates to a plant for carrying out the disclosed method, said plant comprising apparatus for the production of casting moulds and/or apparatus for the production of cores. The plant of the invention is characterized in that the apparatus or parts of it are contained in a cooling chamber whereby the necessary temperature conditions may be readily and constantly maintained so that valuable production time is not lost in waiting for cooling.

When the plant is connected to a casting plant having melting apparatus, a considerable saving in energy may be achieved by an arrangement such that waste heat from the melting apparatus is used for the operation of the cooling system of the cooling chamber.

We claim:

1. A method of producing frozen casting moulds or cores, said method comprising:

(a) providing a granular material;

(b) providing a binder material that is in a fluid state;

(c) cooling the binder material to a temperature below its freezing point to form fine particles;

(d) mixing the granular material and the cooled, particulate binder material to form a homogeneous, easy flowing mixture; and (e) compressing the resulting mixture to bind together the granular material to form a mould or core.

2. A method according to claim 1, wherein said cooled binder material is in the form of fine dendritic particles.

3. A method according to claim 1, wherein said cooled binder material is in the form of finely divided powdered material.

4. A method according to claim 1, including the further step of combining said cooled binder material with liquid gas prior to mixing with the granular material.

5. A method according to claim 1, wherein said binder material comprises water glass and liquid carbon dioxide.

6. A method according to claim 1, wherein said binder material comprises a mixture of polyisocyanate and phenol resin which is activated by pre-frozen liquid dimethylethyl amine or triethyl amine.

7. A method according to claim 1, including the further step of providing deep frozen disposable patterns of a material which evaporates when heated.

8. A method according to claim 7, wherein said disposable patterns are made from a deep-frozen, foamed material.

9. A method according to any of claims 1 to 8, wherein said mould producing method is performed in a cooling chamber maintained at a reduced temperature.

* * * * *